US008196711B2

(12) United States Patent
Tokura

(10) Patent No.: US 8,196,711 B2
(45) Date of Patent: Jun. 12, 2012

(54) ELEVATOR SYSTEM

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 370 days.

(21) Appl. No.: 12/595,523

(22) PCT Filed: Jul. 12, 2007

(86) PCT No.: PCT/JP2007/063895

§ 371 (c)(1),
(2), (4) Date: Oct. 12, 2009

(87) PCT Pub. No.: WO2009/008083

PCT Pub. Date: Jan. 15, 2009

(65) Prior Publication Data

US 2011/0174580 A1 Jul. 21, 2011

(51) Int. Cl.
*B66B 1/18* (2006.01)

(52) U.S. Cl. ..... 187/382; 187/392

(58) Field of Classification Search ..... 187/247, 187/380–389, 391–393

See application file for complete search history.

(56) References Cited

U.S. PATENT DOCUMENTS

| | | | | |
|---|---|---|---|---|
| 4,901,822 | A * | 2/1990 | Tsuji | 187/386 |
| 5,260,526 | A * | 11/1993 | Sirag, Jr. | 187/387 |
| 5,274,202 | A * | 12/1993 | Kezer et al. | 187/385 |
| 6,129,182 | A * | 10/2000 | Nakamura | 187/391 |
| 6,328,134 | B1 * | 12/2001 | Hikita | 187/382 |
| 6,328,135 | B1 * | 12/2001 | Sirag et al. | 187/382 |
| 6,601,678 | B2 * | 8/2003 | Kostka et al. | 187/383 |
| 7,377,364 | B2 * | 5/2008 | Tyni et al. | 187/380 |
| 7,431,130 | B2 * | 10/2008 | Hikita et al. | 187/382 |
| 7,546,906 | B2 * | 6/2009 | Tyni et al. | 187/382 |
| 7,712,586 | B2 * | 5/2010 | Legez | 187/391 |
| 2011/0048866 | A1 * | 3/2011 | Tokura | 187/387 |

(Continued)

FOREIGN PATENT DOCUMENTS

CN 1315284 A 10/2001

(Continued)

OTHER PUBLICATIONS

U.S. Appl. No. 12/524,863, filed Jul. 29, 2009, Tokura.

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator system is obtained which is capable of assigning a suitable car by taking into consideration a change of a maximum speed or an acceleration according to the result of prediction of a change of a car load or a moving distance with respect to a hall call. In the elevator system having a group management control device (20), provision is made for a destination floor registration unit (11) that registers a destination floor according to a call into a call registration device (10) at the time of call registration, and an assignment control unit (21) that assigns a suitable car to a destination call registration request from the call registration device (10). The assignment control unit (21) includes a prediction time calculation unit (22), and calculates a change of the moving distance of each car after the call assignment based on the destination floor, and at the same time calculates each floor arrival prediction time of each car using a speed or an acceleration thereof according to a calculated value of the change of the moving distance.

3 Claims, 6 Drawing Sheets

U.S. PATENT DOCUMENTS

2011/0198160 A1* 8/2011 Suzuki et al. ..... 187/382

FOREIGN PATENT DOCUMENTS

| | | | |
|---|---|---|---|
| CN | 1491179 | A | 4/2004 |
| JP | 57 121571 | | 7/1982 |
| JP | 3 272979 | | 12/1991 |
| JP | 2001 278553 | | 10/2001 |
| JP | 2003 238037 | | 8/2003 |
| JP | 2004-107046 | | 4/2004 |
| WO | WO 2005/121002 | A1 | 12/2005 |
| WO | WO 2007/034560 | A1 | 3/2007 |

OTHER PUBLICATIONS

U.S. Appl. No. 13/260,111, filed Sep. 23, 2011, Tokura.
U.S. Appl. No. 13/057,197, filed Feb. 2, 2011, Tokura, et al.
Office Action issued Feb. 21, 2012 in Japanese Application No. 2009-522481, filed Jun. 11, 2009 (without an English Translation).
Office Action issued Dec. 22, 2011 in Chinese Application No. 200780052997.3 (with an English Translation).

* cited by examiner

ELEVATOR SYSTEM

TECHNICAL FIELD

This invention relates to an elevator system which is capable of causing a plurality of elevator cars (hereinafter referred to simply as "cars") to travel at different speeds, respectively, and in particular it relates to a group management control technique for performing suitable elevator arrival prediction.

BACKGROUND ART

In the past, there has been proposed a suitable group management control technique which is capable of avoiding car arrival prediction errors in an elevator system in which the speeds and/or accelerations of a plurality of cars are changed according to the loads and/or travel distances of the cars (for example, see a first patent document).

In addition, there has also been proposed an elevator system which is capable of shortening an operation time of each car by changing the maximum speed and/or acceleration of each car according to the load and the moving distance thereof (for example, see a second patent document).

The elevator system described in the above-mentioned first patent document is provided with a prediction time calculation unit to calculate a prediction time at which each car arrives at each floor according to an acceleration set based on a prediction result of the load of the car, and an assignment control unit that assigns a suitable car to a hall call (a car call generated at a hall) in consideration of the calculation result of the prediction time. However, in cases where the prediction result of a car load differs from an actual car load, a suitable car can not be assigned.

Although the elevator system described in the above-mentioned second patent document changes the maximum speed and/or acceleration of each car according to the load and moving distance of the car, it is necessary to take account of the change of the maximum speed and/or acceleration of each car at the time of car assignment in cases where group control is carried out for a plurality of cars.

[First Patent Document]

Japanese-patent-application-laid-open No. 2001-278553

[Second Patent Document]

Japanese-patent-application-laid-open No. 2003-238037

DISCLOSURE OF THE INVENTION

Problem to be Solved by the Invention

In an above conventional elevator systems, in the case of the first patent document, there has been a problem that when the prediction result of the car load is different from the actual car load, a suitable car can not be assigned.

In addition, in the case of the second patent document, there has also been a problem that in cases where group control is performed for a plurality of cars, it is necessary to take account of the change of the maximum speed and/or acceleration of each car at the time of car assignment, thereby making the control complicated and reducing the reliability.

The present invention has been made to solve the aforementioned problems, and has for its object to obtain an elevator system which is capable of assigning a suitable car by taking into consideration a change of a maximum speed or acceleration of each car according to the result of prediction of an increase in a car load (change) or a change in a moving distance of each car with respect to a hall call.

Means for Solving the Problems

An elevator system according to the present invention, which includes a group management control device for a plurality of elevator cars, and in which a maximum speed or an acceleration of each of the plurality of elevator cars is changed according to a car load or a moving distance of each of the plurality of elevator cars, comprises: a destination floor registration unit that registers a destination floor according to a call into a call registration device at the time of call registration; and an assignment control unit that assigns a suitable elevator car among the plurality of elevator cars to a destination call registration request from the call registration device; wherein the assignment control unit includes a prediction time calculation unit, and the prediction time calculation unit calculates a change of the moving distance of each elevator car after the call assignment based on the destination floor, and at the same time calculates each floor arrival prediction time of the each elevator car using a speed or an acceleration thereof according to a calculated value of the change of the moving distance.

Effect of the Invention

According to this invention, a suitable car can be assigned by registering a destination floor or the number of passengers at the time of registration of a hall call, correctly predicting an increase in the car load or a change in the moving distance of each car with respect to the hall call, and taking into consideration a change of a maximum speed or acceleration of each car according to the result of the prediction.

BEST MODE FOR CARRYING OUT THE INVENTION

First Embodiment

Figure 1:
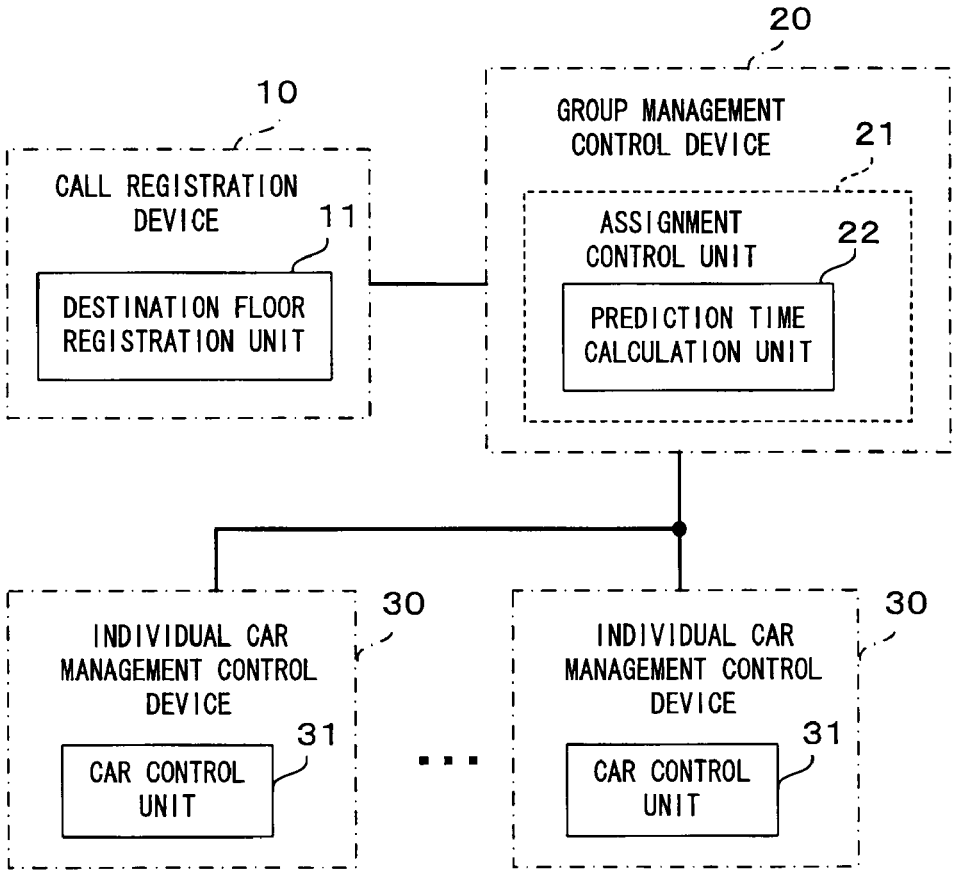
FIG. 1 is a block diagram showing the overall construction of an elevator system according to a first embodiment of this invention. (First Embodiment)

The overall construction of an elevator system according to a first embodiment of this invention is shown in FIG. 1.

In FIG. 1, the elevator system according to the first embodiment of this invention is provided with a call registration device 10 that is arranged near each hall for calling an assigned car to the hall, a group management control device 20 that performs management control of a plurality of cars as a group, and a plurality of individual car management control devices 30 corresponding to individual cars, respectively.

The call registration device 10, the group management control device 20, and the individual car management control devices 30 are connected to one another by a network so that mutual information communications can be carried out.

The call registration apparatus 10 is provided with a destination floor registration unit 11 that serves as a unit to detect a destination floor at the time of registration of a hall call for registering the destination floor at the same time with the call registration. In addition, the call registration device 10 is provided with a button for inputting a destination floor (not shown), for example.

In addition, at the time of call registration, the call registration device 10 may perform the call registration including a destination floor by means of an elevator user's personal digital assistant or the like using a dedicated application.

In this case, anything can be used as the personal digital assistant if wireless communication (infrared ray communication, Internet communication, etc.) can be made between itself and the group management control device 20. For example, a cellular phone, PHS (Personal Handyphone System), PDA (Personal Digital Assistance), or a notebook computer can be used.

Further, the call registration device 10 may be provided with a personal ID verification unit (not shown) including personal ID data registered beforehand, which can verify the personal IDs of elevator users, and at the same time distinguish destination floors by referring to the personal ID data, and perform call registration in an automatic manner. In this case, as a user's personal ID, there is used information beforehand registered into a key, a card, an IC tag or the like which is carried by a user, or biometric information such as a fingerprint, a vein, a voiceprint, an iris, etc., of a user.

The group management control device 20 is provided with an assignment control unit 21 that assigns a car corresponding to a call at the time when call registration is generated, and the assignment control unit 21 includes a prediction time calculation unit 22 that calculates a prediction time at which each car reaches each floor.

The individual car management control devices 30 are each provided with a car control unit 31 for controlling each car.

Next, reference will be made to the operation of the elevator system according to the first embodiment of this invention shown in FIG. 1 in association with the respective devices 10, 20 and 30 while making reference to a flow chart of FIG. 2.

Figure 2:
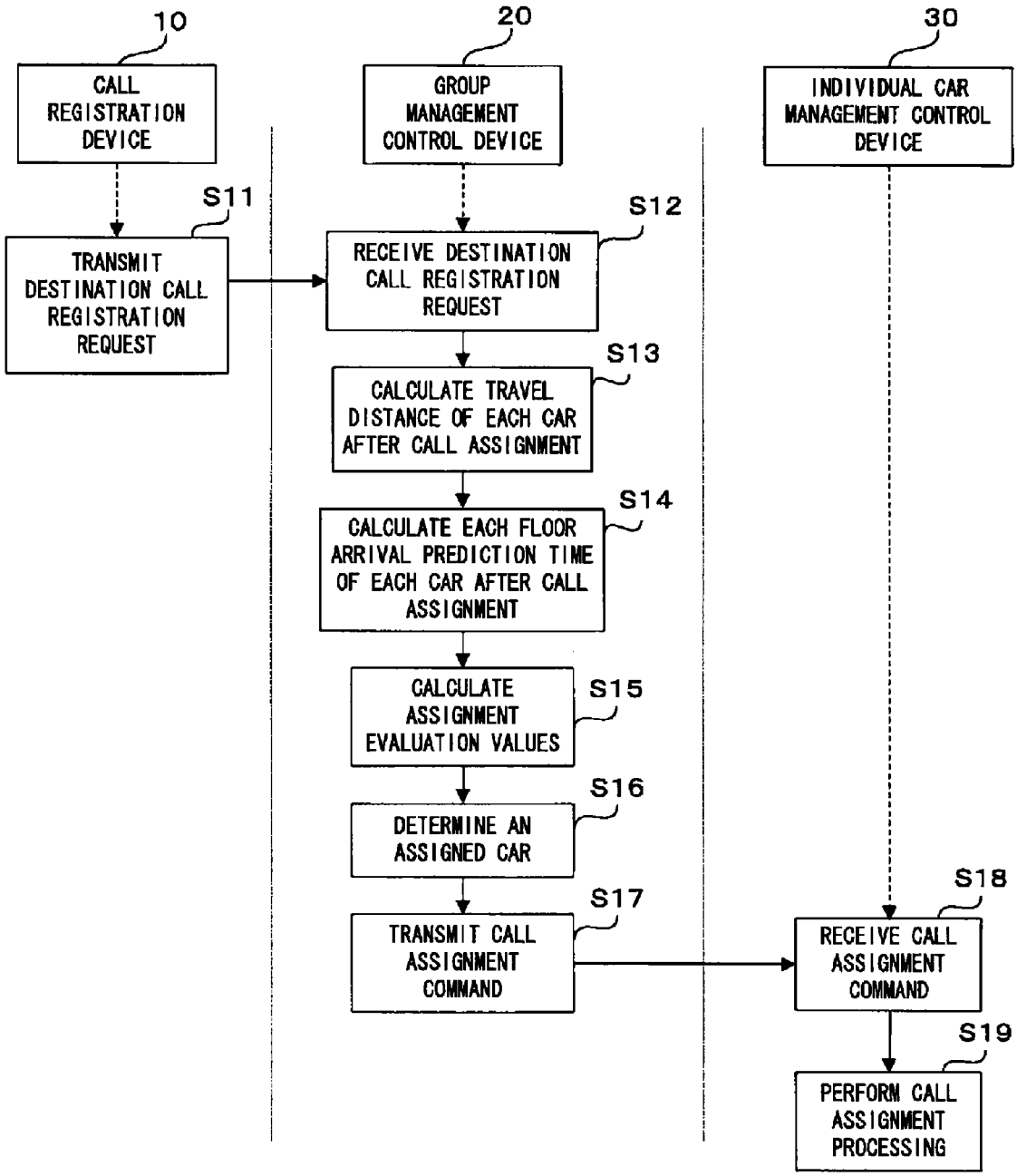
FIG. 2 is a flow chart showing processing by the elevator system according to the first embodiment of this invention. (First Embodiment)

In FIG. 2, first, when a user in a hall registers a destination call which specifies a destination floor, a destination call registration request is transmitted towards the group management control device 20 from the call registration device 10 (step S11).

Then, when the assignment control unit 21 in the group management control device 20 receives the destination call registration request from the call registration device 10 (step S12), the prediction time calculation unit 22 in the assignment control unit 21 calculates a travel distance of each car to the destination floor if the destination call is assigned to each car (step S13).

In addition, the prediction time calculation unit 22 calculates each floor arrival prediction time of each car in the case of assigning the destination call to each car, by using the speed and/or acceleration of each car according to the travel distance thereof (step S14).

Then, the assignment control unit 21 in the group management control device 20 calculates, as assignment evaluation values, performance indices such as a passenger's waiting time at each hall, the presence or absence of through passage at each hall due to full passengers, or the presence or absence of prediction errors, based on the calculated values of individual floor arrival prediction times (step S15), and determines a car, for which an assignment evaluation value becomes the best, as an assigned car (step S16).

Subsequently, the assignment control unit 21 transmits a call assignment command to the car control unit 31 in a individual car management control device 30 which corresponds to the assigned car (step S17).

Finally, when receiving the call assignment command from the assignment control unit 21 (step S18), the car control unit 31 in the corresponding individual car management control device 30 executes call assignment processing to the assigned car, so that the assigned car is caused to perform a call assignment operation (step S19), after which the processing routine of FIG. 2 is ended.

As described above, the elevator system according to the first embodiment of this invention, which includes the group management control device 20 for a plurality of cars and in which the maximum speed or acceleration of each car is changed according to the car load or moving distance of each car, is provided with the destination floor registration unit 11 that registers a destination floor according to a call into the call registration device 10 at the time of call registration, and the assignment control unit 21 that assigns a suitable car among a plurality of cars to a destination call registration request from the call registration device 10.

In addition, the assignment control unit 21 includes the prediction time calculation unit 22, and the prediction time calculation unit 22 calculates a change of the moving distance of each car after the call assignment based on the destination floor, and at the same time calculates each floor arrival prediction time of each car using the speed or the acceleration thereof according to the calculated value of the change of the moving distance.

According to this, it is possible to predict the change of the moving distance to a hall call generated at a hall in an accurate manner at the time of call registration, and at the same time, in cases where each car changes the speed and acceleration thereof according to the travel distance thereof, it is possible to assign an optimal car among the plurality of cars based on a suitable assignment evaluation value in consideration of the change of the maximum speed or the acceleration of each car according to the above-mentioned prediction result of the change of the moving distance. Accordingly, the reliability of the control of the elevator system can be improved.

Second Embodiment

Figure 3:
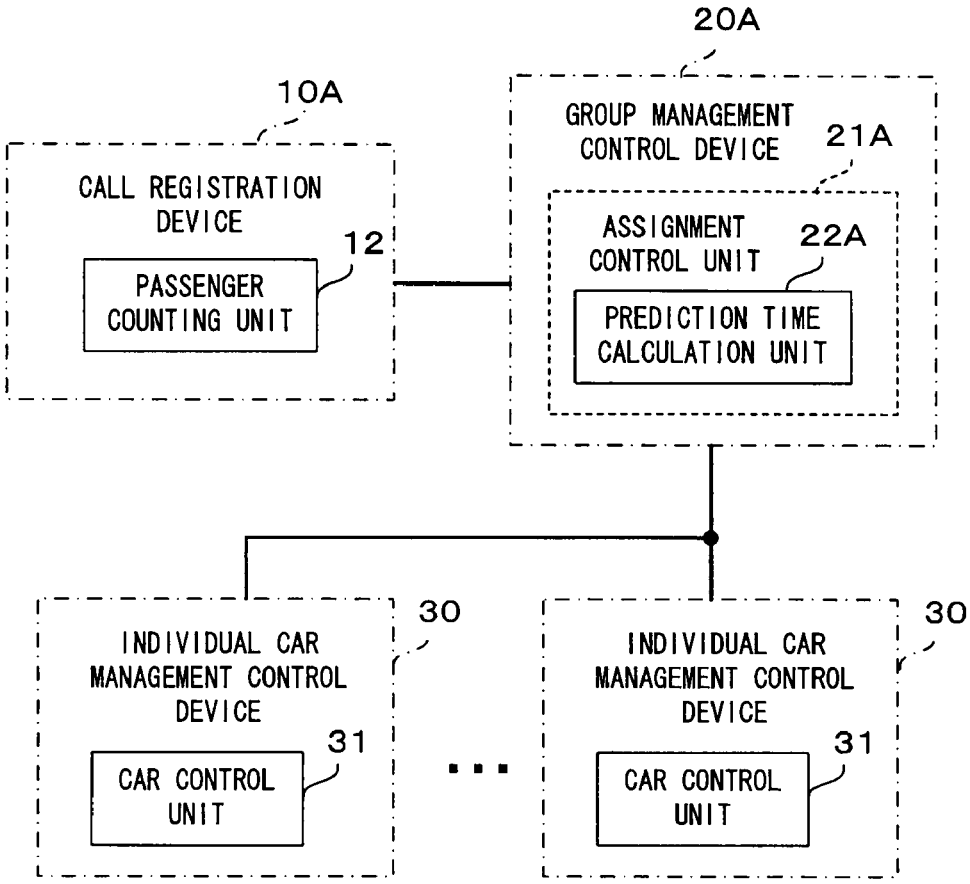
FIG. 3 is a block diagram showing the overall construction of an elevator system according to a second embodiment of this invention. (Second Embodiment)

Here, note that in the above-mentioned first embodiment (FIG. 1), the call registration device 10 is provided with the destination floor registration unit 11 and a destination floor is registered simultaneously at the time of call registration, but as shown in FIG. 3, a call registration device 10A may be provided with a passenger counting unit 12, and a measured value of the number of passengers (corresponding to the change of a car load) may be registered simultaneously at the time of call registration.

FIG. 3 is a block diagram showing an elevator system according to a second embodiment of this invention. In FIG. 3, those components which are similar to the above-mentioned ones (see FIG. 1) are denoted by the same reference numerals and characters as those in the above-mentioned embodiment, or with "A" being attached to reference numerals, and a detailed description thereof is omitted.

In this case, the call registration device 10A is provided with a passenger counting unit 12 as a unit to detect the number of passengers at the time of hall call registration, and the passenger counting unit 12 counts or measures the number of passengers according to calls and registers a measured value of the number of passengers into the call registration device 10A simultaneously at the time of call registration.

The passenger counting unit 12 may be constructed such that it has a sensor unit, such as for example a camera or a weight sensor, for detecting the number of users near a hall, and operates to perform call registration in an automatic manner upon detection of a user(s).

In addition, the call registration device 10A may measure the number of passengers by performing call registration including a destination floor by means of a user's personal digital assistant or the like using a dedicated application, as stated above.

Further, the call registration device 10A may measure the number of passengers by performing call registration in an automatic manner when verifying the personal IDs of the users, and by each user's performing call registration, as stated above.

Figure 4:
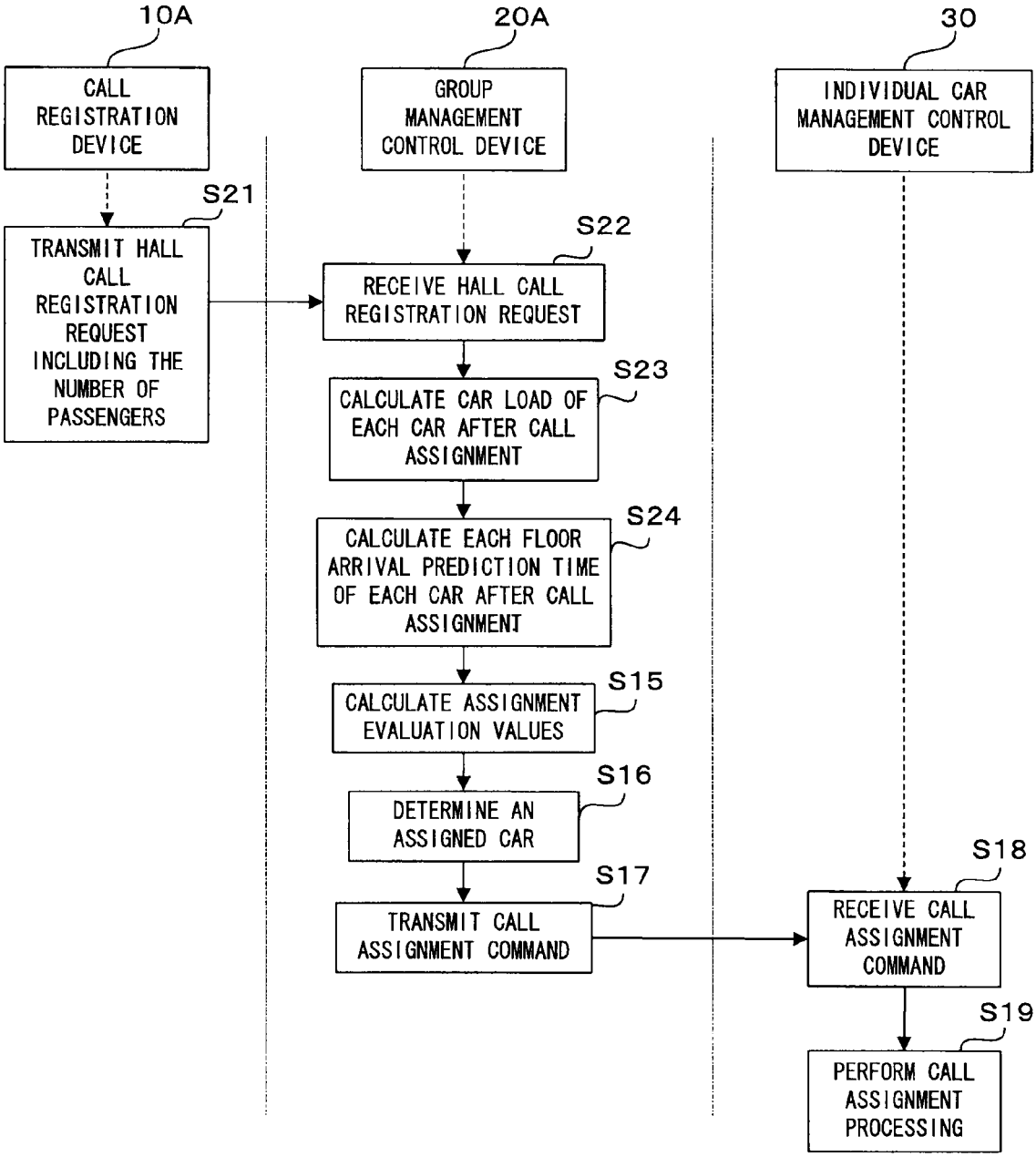
FIG. 4 is a flow chart showing processing by an elevator system according to the second embodiment of this invention. (Second Embodiment)

Next, reference will be made to the operation of the elevator system according to the second embodiment of this invention shown in FIG. 3 in association with the respective devices 10A, 20A and 30 while making reference to a flow chart of FIG. 4. In FIG. 4, those processes which are similar to the above-mentioned ones (see FIG. 2) are denoted by the same reference numerals and characters as those in the above-mentioned embodiment.

First, when a user in a hall registers a hall call, a hall call registration request including the number of passengers (measured value) is transmitted towards a group management control device 20A from the call registration device 10A (step S21).

Subsequently, when an assignment control unit 21A in the group management control device 20A receives the hall call registration request from the call registration device 10A (step S22), a prediction time calculation unit 22A in the assignment control unit 21A calculates from the number of passengers the car load of each car in the case of the hall call being assigned to each car (step S23).

In addition, the prediction time calculation unit 22A calculates each floor arrival prediction time of each car in the case of the hall call being assigned to each car, by using the speed and the acceleration of each car according to the car load thereof (step S24).

Thereafter, the assignment control unit 21A in the group management control device 20A calculates, as assignment evaluation values, performance indices such as a passenger's waiting time at each hall, through passage at each hall due to full passengers, or the presence or absence of prediction errors, based on the calculated values of individual floor arrival prediction times (step S15), and determines a car, for which an assignment evaluation value becomes the best, as an assigned car (step S16).

Subsequently, the assignment control unit 21A transmits a call assignment command to a car control unit 31 in a individual car management control device 30 which corresponds to the assigned car (step S17).

Hereinafter, when receiving the call assignment command from the assignment control unit 21A (step S18), the car control unit 31 in the corresponding individual car management control device 30 executes call assignment processing to the assigned car, so that the assigned car is caused to perform a call assignment operation (step S19), after which the processing routine of FIG. 4 is ended.

As described above, the elevator system according to the second embodiment of this invention is provided with the passenger counting unit 12 that counts or measures the number of passengers according to calls and registers the measured value of the number of passengers into the call registration device 10A at the time of call registration, and the assignment control unit 21A that assigns a suitable car among a plurality of cars to a call registration request including the number of passengers from the call registration device 10A.

In addition, in the group management control device 20A, the assignment control unit 21A includes the prediction time calculation unit 22A, and the prediction time calculation unit 22A calculates a change of the car load of each car after the call assignment based on the number of passengers, and at the same time calculates each floor arrival prediction time of each car by using the speed or the acceleration thereof according to the calculated value of the change of the car load.

As a result, at the time of call registration, an increase (change) in the car load to a hall call generated at a hall can be predicted in an accurate manner, and an optimal car among the plurality of cars can be assigned based on a suitable assignment evaluation value in consideration of a change in the maximum speed or a change in the acceleration of each car according to the prediction result of the increase in the car load. Accordingly, the reliability of the control of the elevator system can be improved.

Third Embodiment

Figure 5:
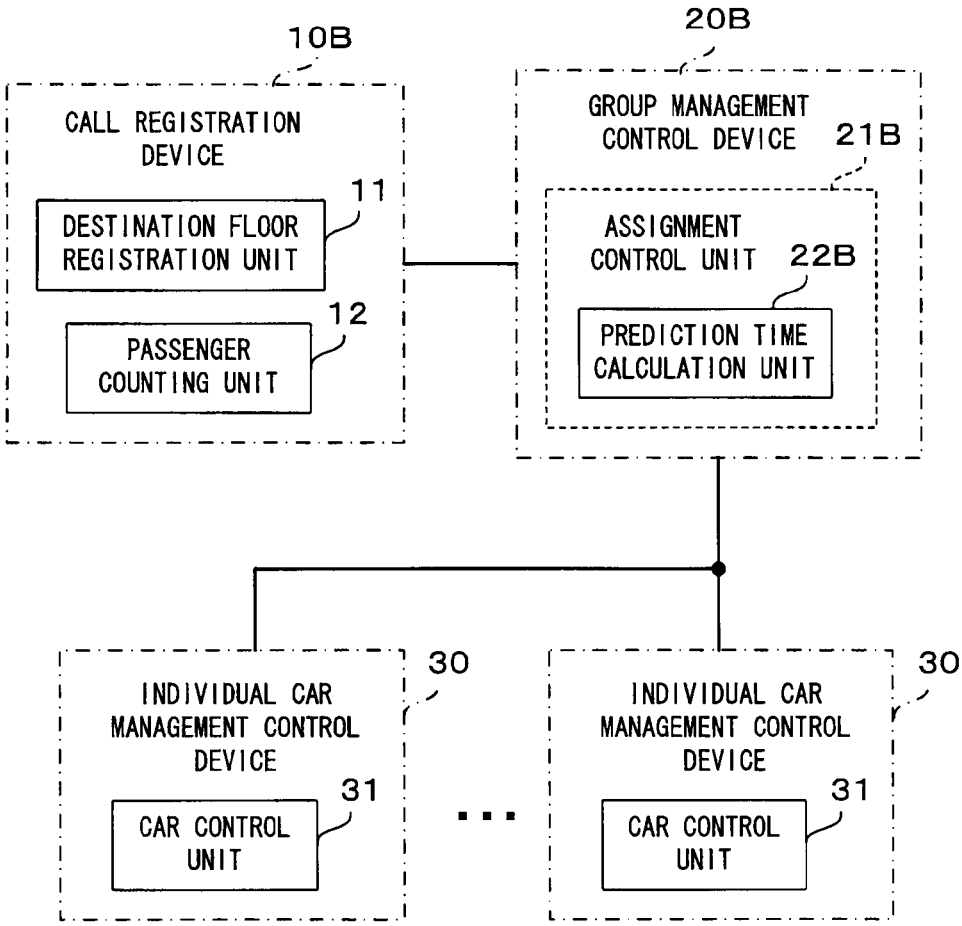
FIG. 5 is a block diagram showing the overall construction of an elevator system according to a third embodiment of this invention. (Third Embodiment)

Here, note that in the above-mentioned the first and second embodiments (FIG. 1 and FIG. 3), the call registration device 10 or 10A is provided with either the destination floor registration unit 11 or the passenger counting unit 12, but as shown in FIG. 5, a call registration device 10B is provided with both the destination floor registration unit 11 and the passenger counting unit 12.

FIG. 5 is a block diagram showing an elevator system according to a third embodiment of this invention. In FIG. 5, those components which are similar to the above-mentioned ones (see FIG. 1 and FIG. 3) are denoted by the same reference numerals and characters as those in the above-mentioned embodiments, or with "B" being attached to reference numerals, and a detailed description thereof is omitted.

In this case, the call registration device 10B is provided with a destination floor registration unit 11 for registering a destination floor simultaneously at the time of call registration, and a passenger counting unit 12 that registers a measured value of the number of passengers into the call registration device 10A simultaneously at the time of call registration.

The destination floor registration unit 11 and the passenger counting unit 12 in the call registration device 10B may be composed of a button for inputting the destination floor, and a button for inputting the number of passengers, respectively.

In addition, the call registration device 10B may measure the number of passengers by performing call registration including a destination floor by means of a user's personal digital assistant or the like using a dedicated application, as stated above.

Further, the call registration device 10A may count or measure the number of passengers by distinguishing destination floors with reference to personal ID data when verifying the personal IDs of users, performing call registration in an automatic manner, and by each user's performing call registration, as stated above.

Figure 6:
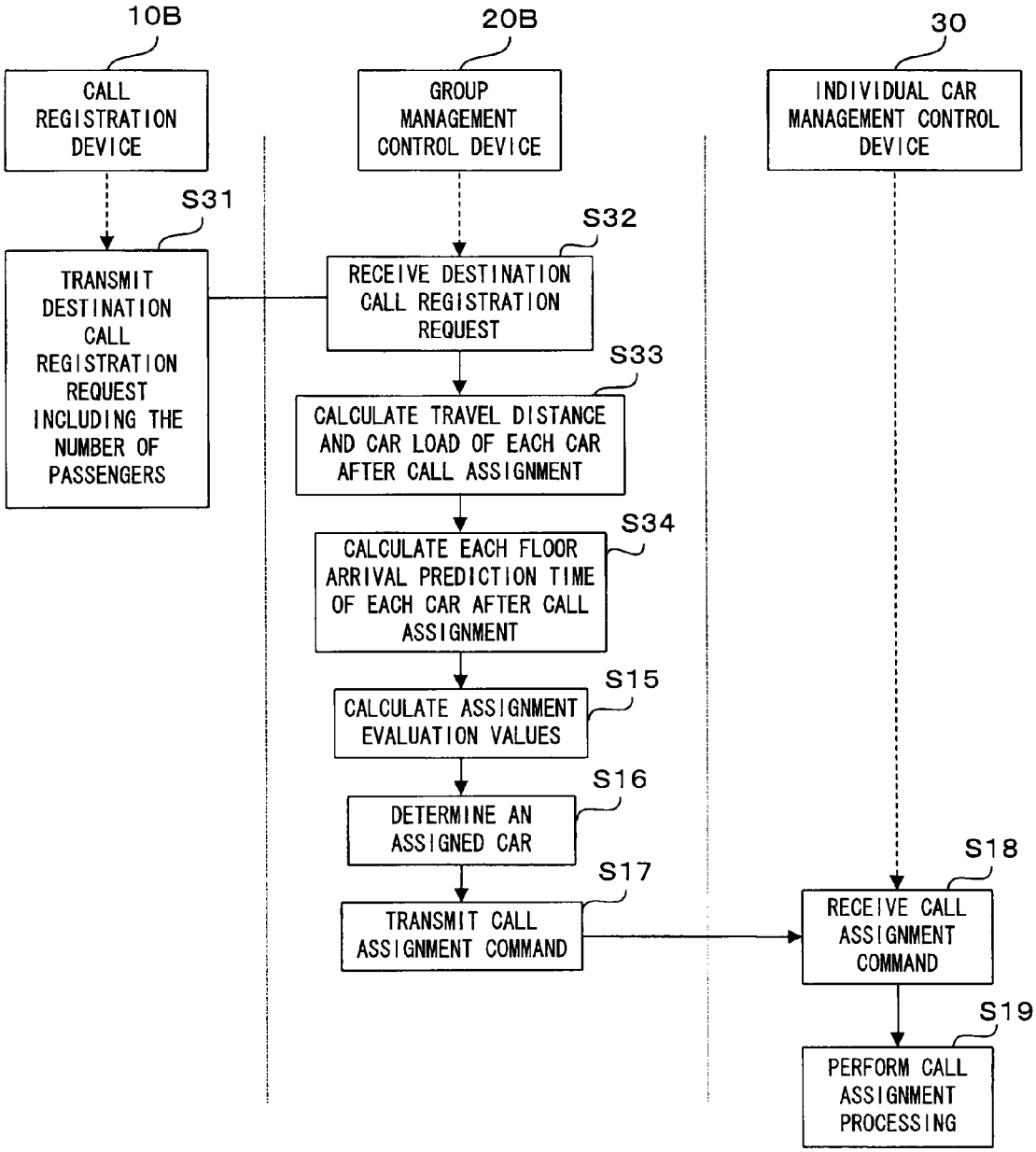
FIG. 6 is a flow chart showing processing by an elevator system according to the third embodiment of this invention. (Third Embodiment)

Next, reference will be made to the operation of the elevator system according to the third embodiment of this invention shown in FIG. 5 in association with respective devices 10B, 20B and 30 while making reference to a flow chart of FIG. 6. In FIG. 6, those processes which are similar to the above-mentioned ones (see FIG. 2 and FIG. 4) are denoted by the same reference numerals and characters as those in the above-mentioned embodiments.

First, when a user in a hall registers a destination call designating a destination floor and the number of passengers, a destination call registration request including the number of passengers (measured value) is transmitted towards a group management control device 20B from the call registration device 10B (step S31).

Subsequently, when an assignment control unit 21B in the group management control device 20B receives the destination call registration request including the number of passengers from the call registration device 10B (step S22), a prediction time calculation unit 22B in the assignment control unit 21B calculates a travel distance (based on the destination floor) and a car load (based on the number of passengers) of each car in the case of assigning the destination call to each car (step S33).

In addition, the prediction time calculation unit 22B calculates each floor arrival prediction time of each car in the case of assigning the destination call to each car, by using the speed and acceleration of each car according to the travel distance and the car load thereof (step S34).

Thereafter, the assignment control unit 21B in the group management control device 20B calculates, as assignment evaluation values, performance indices such as a passenger's waiting time at each hall, through passage at each hall due to full passengers, or the presence or absence of prediction errors, based on the calculated values of individual floor arrival prediction times (step S15), and determines a car, for which an assignment evaluation value becomes the best, as an assigned car (step S16).

Subsequently, the assignment control unit 21B transmits a call assignment command to a car control unit 31 in a individual car management control device 30 which corresponds to the assigned car (step S17).

Hereinafter, when receiving the call assignment command from the assignment control unit 21B (step S18), the car control unit 31 in the corresponding individual car management control device 30 executes call assignment processing to the assigned car, so that the assigned car is caused to perform a call assignment operation (step S19), after which the processing routine of FIG. 4 is ended.

As described above, the elevator system according to the third embodiment of this invention is provided with the destination floor registration unit 11 that registers a destination floor according to a call into the call registration device 10B at the time of call registration, the passenger counting unit 12 that counts or measures the number of passengers according to the call and registers the measured value of the number of passengers into the call registration device 10B at the time of call registration, and the assignment control unit 21B that assigns a suitable car among a plurality of cars to a destination call registration request including the number of passengers from the call registration device 10B.

In addition, the assignment control unit 21B includes the prediction time calculation unit 22B, and the prediction time calculation unit 22B calculates a change of the travel distance and a change of the car load of each car after the call assignment based on the destination floor and the number of passengers, and at the same time calculates each floor arrival prediction time of each car by using the speed or acceleration thereof according to the respective calculated values of the changes of the travel distance and the car load.

As a result, at the time of call registration, an increase (change) in the car load or a change in the travel distance to a hall call generated at a hall can be predicted in an accurate manner, and an optimal car among the plurality of cars can be assigned based on a suitable assignment evaluation value in consideration of a change in the maximum speed or acceleration according to the prediction result of these changes. Accordingly, the reliability of the control of the elevator system can be improved.

The invention claimed is:

1. An elevator system which includes a group management control device for a plurality of elevator cars, and in which a maximum speed or an acceleration of each of said plurality of elevator cars is changed according to a car load or a moving distance of each of said plurality of elevator cars, said elevator system characterized by comprising:

a destination floor registration unit that registers a destination floor according to a call into a call registration device at the time of call registration; and an assignment control unit that assigns a suitable elevator car among said plurality of elevator cars to a destination call registration request from said call registration device;

wherein said assignment control unit includes a prediction time calculation unit, and said prediction time calculation unit calculates a change of the moving distance of each elevator car after the call assignment based on said destination floor, and at the same time calculates each floor arrival prediction time of said each elevator car using a speed or an acceleration thereof according to a calculated value of said change of the moving distance.

2. An elevator system which includes a group management control device for a plurality of elevator cars, and in which a maximum speed or an acceleration of each of said plurality of elevator cars is changed according to a car load or a moving distance of each of said plurality of elevator cars, said elevator system characterized by comprising:

a passenger counting unit that measures the number of passengers according to a call, and registers a measured value of said number of passengers into a call registration device at the time of call registration; and an assignment control unit that assigns a suitable elevator car among said plurality of elevator cars to a call registration request including said number of passengers from said call registration device;

wherein said assignment control unit includes a prediction time calculation unit, and said prediction time calculation unit calculates a change of the car load of each elevator car after the call assignment based on said number of passengers, and at the same time calculates each floor arrival prediction time of said each elevator car using a speed or an acceleration thereof according to a calculated value of said change of the car load.

3. An elevator system which includes a group management control device for a plurality of elevator cars, and in which a maximum speed or an acceleration of each of said plurality of elevator cars is changed according to a car load or a moving distance of each of said plurality of elevator cars, said elevator system characterized by comprising:

a destination floor registration unit that registers a destination floor according to a call into a call registration device at the time of call registration;

a passenger counting unit that measures the number of passengers according to said call, and registers a measured value of said number of passengers into said call registration device at the time of said call registration; and an assignment control unit that assigns a suitable elevator car among said plurality of elevator cars to a destination call registration request including said number of passengers from said call registration device;

wherein said assignment control unit includes a prediction time calculation unit, and said prediction time calculation unit calculates a change of a moving distance, and a change of a car load of each elevator car after call assignment based on said destination floor and said number of passengers, and at the same time calculates each floor arrival prediction time of said each elevator car using a speed or an acceleration thereof according to a calculated value of each of said change of said moving distance and said change of said car load.

* * * * *